US011473752B2

(12) United States Patent
Lara-Cabeza et al.

(10) Patent No.: US 11,473,752 B2
(45) Date of Patent: Oct. 18, 2022

(54) VEHICLE LAMP INCORPORATING MEANS FOR PROTECTION AGAINST ELECTROSTATIC DISCHARGES

(71) Applicant: VALEO VISION, Bobigny (FR)

(72) Inventors: Juan Lara-Cabeza, Bobigny (FR); Miguel-Angel Pena, Bobigny (FR); Juan-Jose Santaella, Bobigny (FR); Antonio Domingo Illan, Bobigny (FR); Jose-David Roldan, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 17/415,424

(22) PCT Filed: Dec. 11, 2019

(86) PCT No.: PCT/EP2019/084540
§ 371 (c)(1),
(2) Date: Jun. 17, 2021

(87) PCT Pub. No.: WO2020/126714
PCT Pub. Date: Jun. 25, 2020

(65) Prior Publication Data

US 2022/0065423 A1 Mar. 3, 2022

(30) Foreign Application Priority Data

Dec. 20, 2018 (EP) ..... 18382959

(51) Int. Cl.
*F21S 45/10* (2018.01)
*F21S 41/37* (2018.01)
(Continued)

(52) U.S. Cl.
CPC ..... *F21S 45/10* (2018.01); *F21V 23/001* (2013.01); *F21V 23/06* (2013.01); *F21S 41/37* (2018.01); *F21Y 2115/10* (2016.08)

(58) Field of Classification Search
CPC ..... F21S 45/10; F21S 41/37; F21S 41/198; F21S 41/192; F21S 43/195; F21V 23/001; F21V 23/06; F21Y 2115/10
See application file for complete search history.

(56) References Cited

U.S. PATENT DOCUMENTS 6,072,277 A 6/2000 Yamamoto et al.
2001/0026836 A1 10/2001 Inaba
(Continued)

FOREIGN PATENT DOCUMENTS

DE 197 37 640 A1 3/1998
DE 20 2004 009 377 U1 9/2004
(Continued)

OTHER PUBLICATIONS

International Search Report dated Mar. 6, 2020 in PCT/EP2019/084540 filed on Dec. 11, 2019.

*Primary Examiner* — Anabel Ton
(74) *Attorney, Agent, or Firm* — Oblon, McClelland, Maier & Neustadt, L.L.P.

(57) ABSTRACT

A vehicle lamp that incorporates means for protection against electrostatic discharges. Sn an embodiment, the vehicle Samp includes a metalized part that is made from synthetic polymer and that is metalized at least on one side of it. The vehicle lamp further includes a metalized retaining clip integral with the metalized part, and a grounding cable electrically connecting the metalized part to the ground via the metalized retaining clip. A first end of the grounding cable is fixed to a locking end of the metalized retaining clip and a second end of the grounding cable is connected to the ground to ensure a proper connection between the metalized part and the ground.

17 Claims, 4 Drawing Sheets

(51) Int. Cl.

| | |
|---|---|
| ***F21V 23/00*** | (2015.01) |
| ***F21V 23/06*** | (2006.01) |
| *F21Y 115/10* | (2016.01) |

(56) References Cited

U.S. PATENT DOCUMENTS

| | | | | |
|---|---|---|---|---|
| 2012/0163008 | A1* | 6/2012 | Matsumoto ..... | F21S 41/192<br>362/507 |
| 2017/0009954 | A1 | 1/2017 | Ueno et al. | |

FOREIGN PATENT DOCUMENTS

| | | | |
|---|---|---|---|
| DE | 10 2016 112 331 | A1 | 1/2017 |
| GB | 2 360 775 | A | 10/2001 |

* cited by examiner

VEHICLE LAMP INCORPORATING MEANS FOR PROTECTION AGAINST ELECTROSTATIC DISCHARGES

TECHNICAL FIELD

The present invention relates to the field of vehicle lamps for motor vehicles and relates more particularly to such devices incorporating protection of electronic components sensitive to an electrostatic discharge.

STATE OF THE ART

In the field of vehicle lamps such as headlamps or rear lamps for motor vehicles, the use of light sources such as light-emitting diodes (LEDs), organic light-emitting diodes (OLED) or laser diode is increasingly specified. The vehicle lamps include LEDs as lighting sources for different functions. The LEDs are disposed on an inner side of a transparent outer lens. The vehicle lamps include one or more reflectors, which are metalized, for reflecting light emitted from the light emitting diodes toward the outer lens. The one or more conductive reflectors may be disposed between the light emitting diodes and the surface cover. Further, thermal cooling means are also associated with the vehicle lamps equipped with the LEDs, which are generally supported by a printed circuit board that also supports electronic components for powering and controlling the LEDs. The thermal cooling means may be a metalized heat sink. Vehicle lamps may also comprise other metalized parts than reflector, such as decorative bezel.

LEDs are sensitive electronic components, notably sensitive to electrostatic discharges. During the service life of a motor vehicle, such components may be exposed to electrostatic discharges inside the vehicle lamps of which they form part, and they may prone to fail in case of the electrostatic discharge. There are several reasons for the occurrence of the static electricity in the vehicle lamps of the motor vehicles. For example, vehicles may be washed when their bodies are stained. After the washing, the outer lens of the vehicle lamps are wiped over with a cloth. While the vehicles are running, pebbles etc. may hit the outer lens of vehicle lamps to cause rubbing there between. Furthermore, in a distribution stage of vehicles, static electricity may occur on the outer lens of the vehicle lamps due to friction. Accordingly, static electricity tends to occur on the outer lens of the vehicle lamps frequently or periodically.

Considering the above circumstances and the structure of the vehicle lamps, the static electricity occurring in the outer lens of the vehicle lamp could cause inductive charging or discharge and cause static electricity charging of the reflector, which is proximity to the LEDs and then, the static electricity stored in the reflector could act on the LEDs through discharge. If the LEDs are subjected to discharges, there is a high risk of premature deterioration or even premature destruction of the LEDs.

In order to protect the LEDs from the static electricity, it is known to provide protection for the LEDs by grounding the one or more conductive reflectors such that the static electricity stored in the reflector is guided to the ground. Therefore, such a phenomenon can be prevented that static electricity stored in the reflector is discharged between the reflector and the LEDs, which are in proximity to the reflector. As a result, the LEDs can be prevented from breaking down due to static electricity. However, known techniques employ metallic SMT parts, screws and other different additional components to ground the reflectors.

Thus, making the structure or the configuration of the vehicle lamps more complex and process for employing such additional components is expensive.

SUMMARY OF THE INVENTION

An object of the invention is to alleviate the problems raised by the prior art. To be more precise, an object of the invention is to provide a vehicle lamp incorporating means for protection of electronic components sensitive to an electrostatic discharge, without using additional components and expensive process.

Other object of the present invention is to provide a vehicle lamp having a metalized part, for example, a reflector, with integrated metalized retaining clip to protect the electronic components against the electrostatic discharge.

According to one non-limiting embodiment of the present invention, there is provided a vehicle lamp, comprising: a metalized part that is made in synthetic polymer and that is metalized at least on one side of it, characterized in that, the vehicle lamp further comprises a metalized retaining clip integral with the metalized part, and a grounding cable electrically connecting the metalized part to the ground via the metalized retaining clip.

According to one non-limiting embodiment of the present invention, a first end of the grounding cable is fixed to a locking end of the metalized retaining clip and a second end of the grounding cable is connected to the ground.

According to one non-limiting embodiment of the present invention, metalized retaining clip is a type of a snap-fit connector connecting the grounding cable and the metalized part According to one non-limiting embodiment of the present invention, the metalized part is a reflector.

According to one non-limiting embodiment of the present invention, the metalized retaining clip is formed integrally with the reflector at lower portion of a side opposite to a reflective side of the reflector.

According to one non-limiting embodiment of the present invention, the vehicle lamp further comprises

- a transparent outer lens;
- one or more light emitting diodes that emit light, wherein the one or more light emitting diodes being disposed on an inner side of the transparent surface cover;
- a printed circuit board (PCB) to carry the one or more light emitting diodes, and the PCB is arranged on a metalized heat sink; and
- wherein the metalized part is fixed to the metalized heat sink by fasteners.

According to one non-limiting embodiment of the present invention, the first end of the grounding cable includes a terminal clip to lock with the locking end of the metalized retaining clip.

According to one non-limiting embodiment of the present invention, the metalized retaining clip comprises at least two jaws.

According to one non-limiting embodiment of the present invention, the terminal clip is made in synthetic polymer material or in metal.

Thus, without using additional components, metallized reflector can be set to ground voltage potential, therefore, in case, ESD discharge happens it discharged to ground directly. As a result, the LEDs can be prevented from breaking down due to static electricity.

BRIEF DESCRIPTION OF THE INVENTION

To complete the description and in order to provide for a better understanding of the invention, a set of drawings is provided. Said drawings form an integral part of the description and illustrate an embodiment of the invention, which should not be interpreted as restricting the scope of the invention, but just as example of how the invention can be carried out. The drawings comprise the following features.

Figure 1:
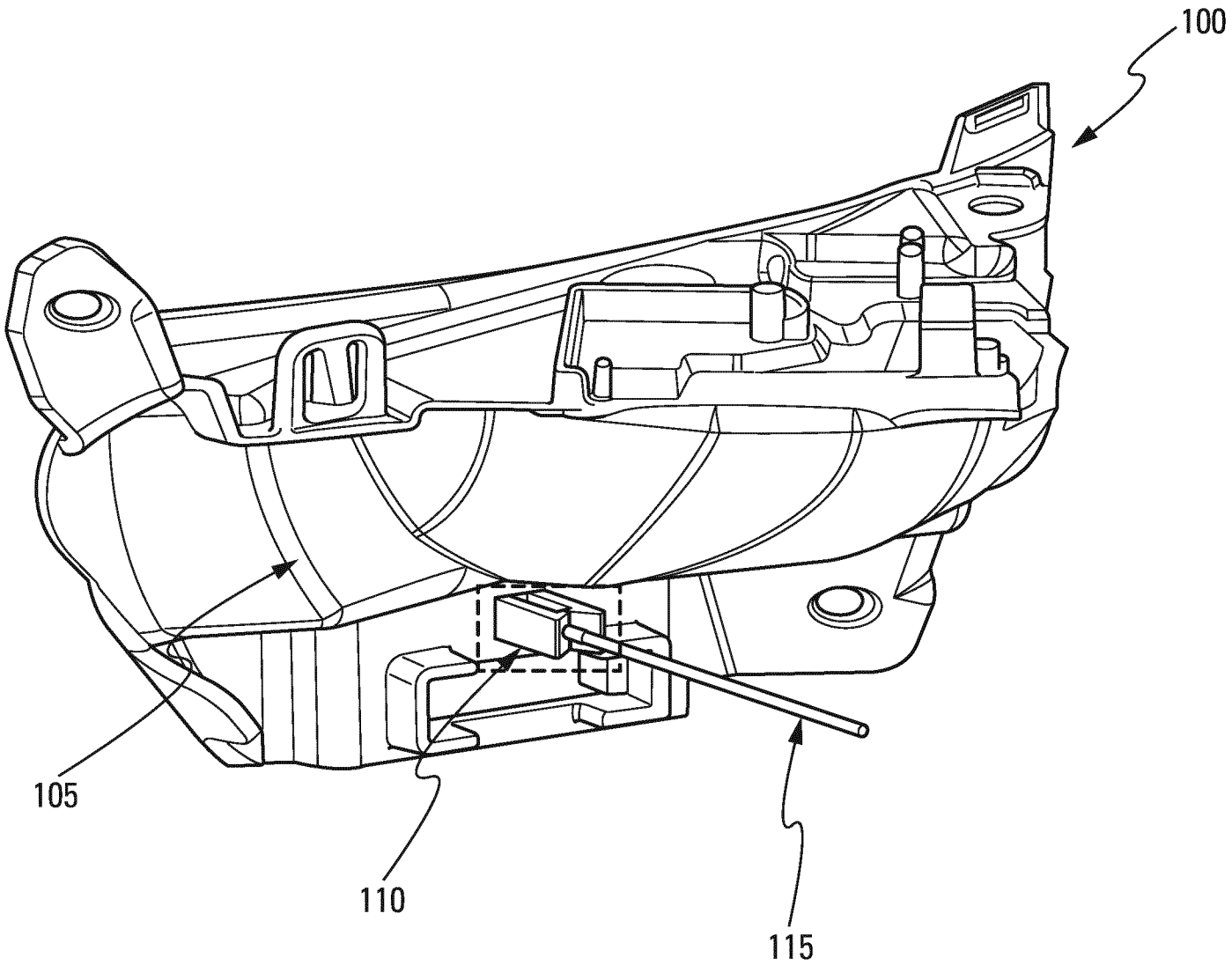
FIG. 1 shows a perspective view of a rear face of a vehicle lamp having a metalized part integral with a metalized retaining clip, in accordance with an embodiment of the present invention.
Figure 3C:
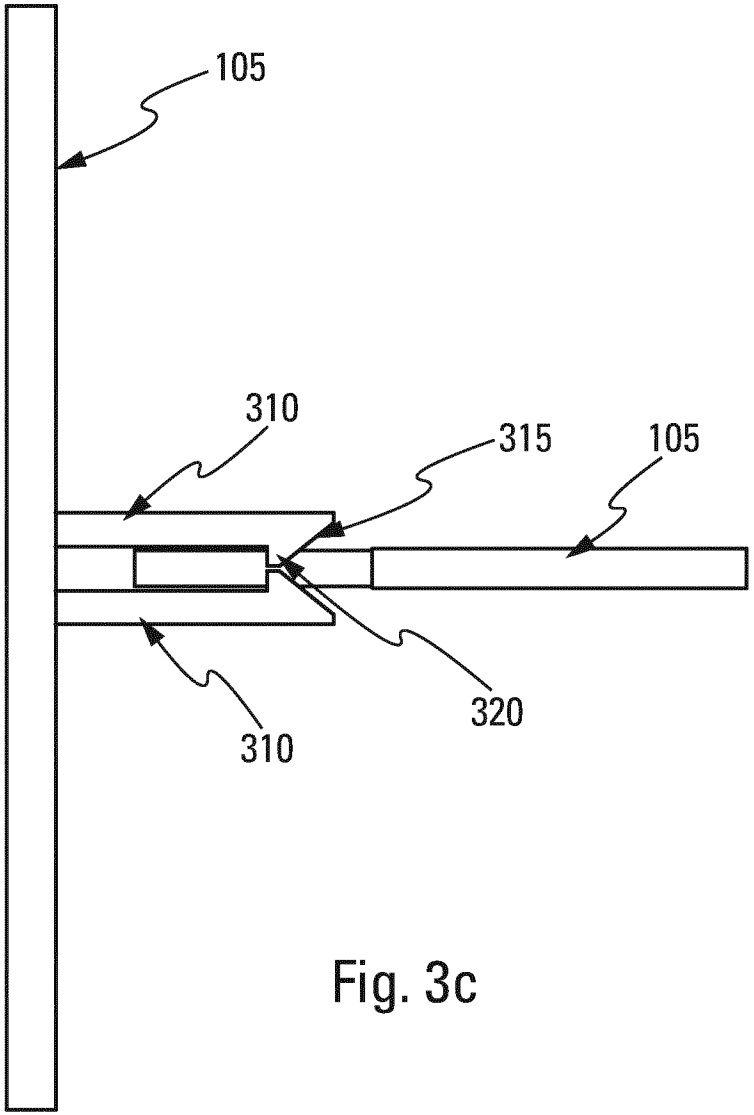
Figure 3A:
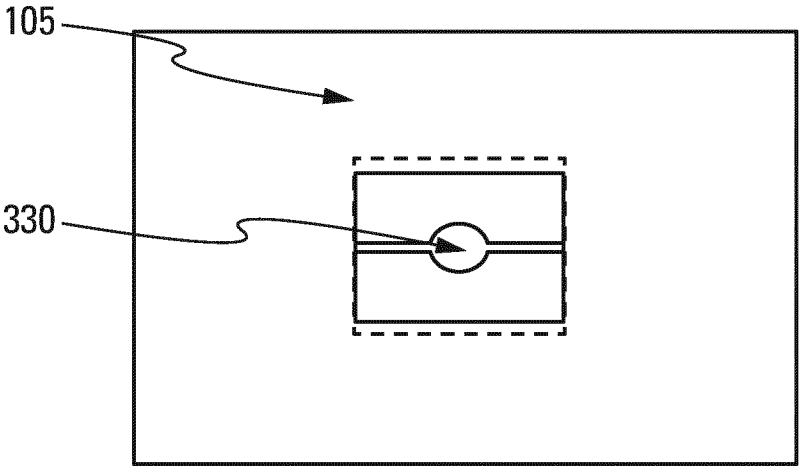

FIG. 3*a* is a front view of the cut portion of the metalized part with the integrated metalized retaining clip shown in the FIG. 1, in accordance with an embodiment of the present invention.

Figure 3B:
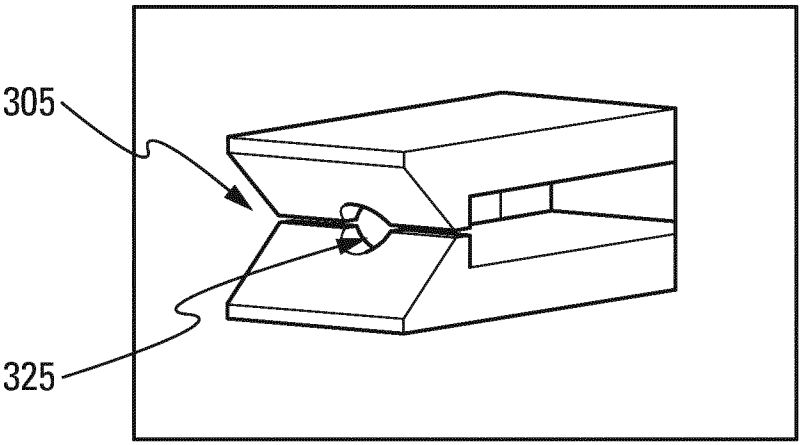

FIG. 3*b* is an isometric view of the integrated cut portion of the metalized part with the integrated metalized retaining clip shown in the FIG. 1, in accordance with an embodiment of the present invention.

FIG. 3*c* is a side view of the cut portion of the metalized part with the integrated metalized retaining clip assembled with a grounding cable, in accordance with an embodiment of the present invention.

Figure 4:
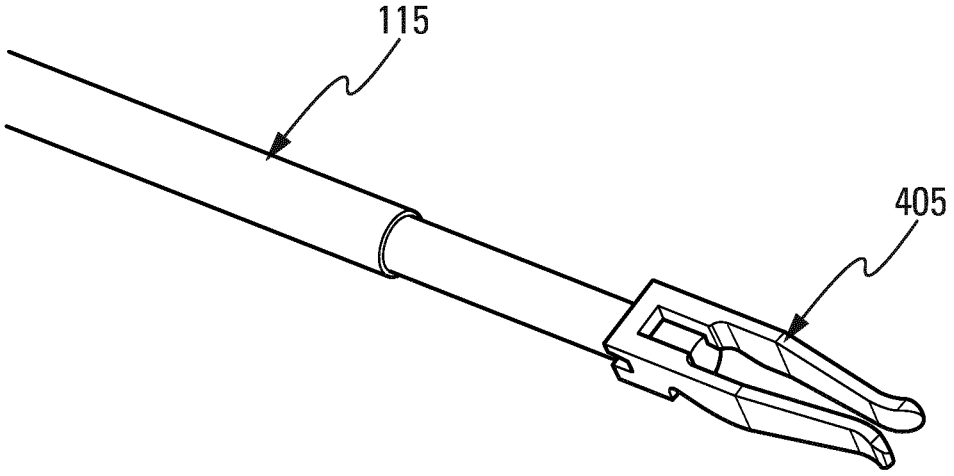

FIG. 4 is a grounding cable with a terminal clip, in accordance with an embodiment of the present invention.

DETAILED DESCRIPTION OF THE INVENTION

Hereinafter, embodiments of the present invention will be described with reference to the accompanying drawings.

In what follows, the technical features described for one precise embodiment may be combined with features from other embodiments without thereby departing from the scope of the invention, unless indicated to the contrary or unless the elements described for various embodiments describe alternative solutions.

FIG. 1 shows a perspective view of a rear face of a vehicle lamp 100 having a metalized part 105 integral with a metalized retaining clip 110, in accordance with an embodiment of the present invention. The vehicle lamp 100 according to an embodiment is one of right and left headlamps (which will be referred to as a "headlamp"). The headlamp is attached to a vehicle body at front-left or front-right and illuminates a region ahead of the vehicle. The headlamp includes a lamp body and a front cover. The lamp body is formed with a front opening. The front cover closes the opening of the front cover. In an embodiment, the front cover is a transparent outer lens. The front cover and the lamp body form an airtight lamp chamber inside therein. One or more light emitting diodes that emit light are disposed on an inner side of the transparent outer lens. The lamp chamber further provided with a printed circuit board (PCB) to carry the one or more light emitting diodes, and the PCB may be arranged on a metalized heat sink. Further, the vehicle lamp includes a metalized plastic part 105, for example, a reflector, that reflects the light emitted from the light emitting diodes towards the transparent outer lens.

In an embodiment, the metalized plastic part 105 is made from synthetic polymer and the metalized part is metalized at least on one side of it. The metallization of the plastic part is preferably made with aluminium and the thickness of a coating layer is preferably between 100 to 300 nanometer.

The metalized plastic part 105 may be fixed to the metalized heat sink (not shown in Figures) by fasteners. Although the present invention is explained with respect to the reflector, it is understood to a person skilled in the art that the present invention can be adapted to any metalized parts, for example, metalized heat sink.

A rear face of a vehicle lamp 100 having the metalized plastic part 105 is illustrated in the FIG. 1*a*. As can be seen from the FIG. 1*a*, the vehicle lamp 100 further comprises a metalized retaining clip 105 formed integrally with the metalized plastic part 105. In an embodiment, the metalized retaining clip 105 is formed integrally with the metalized plastic part 105 at lower portion of a side opposite to a reflective side of the metalized plastic part 105, for example, reflector. Alternatively, the metalized retaining clip 110 may be formed integrally with the metalized plastic part 105 on a flat surface of the side opposite to the reflective side of the reflector 105. Further, the metallized retaining clip 110 may be formed integrally with the metalized plastic part 105 on a flat surface near to an electrical connector to avoid lengthy cable. The position of the metalized retaining clip 110 may also depend on the mould configuration of the metalized plastic part 105.

In an embodiment, the metalized retaining clip 110 and the metalized part 105 may be metalized at same time.

Figure 2:
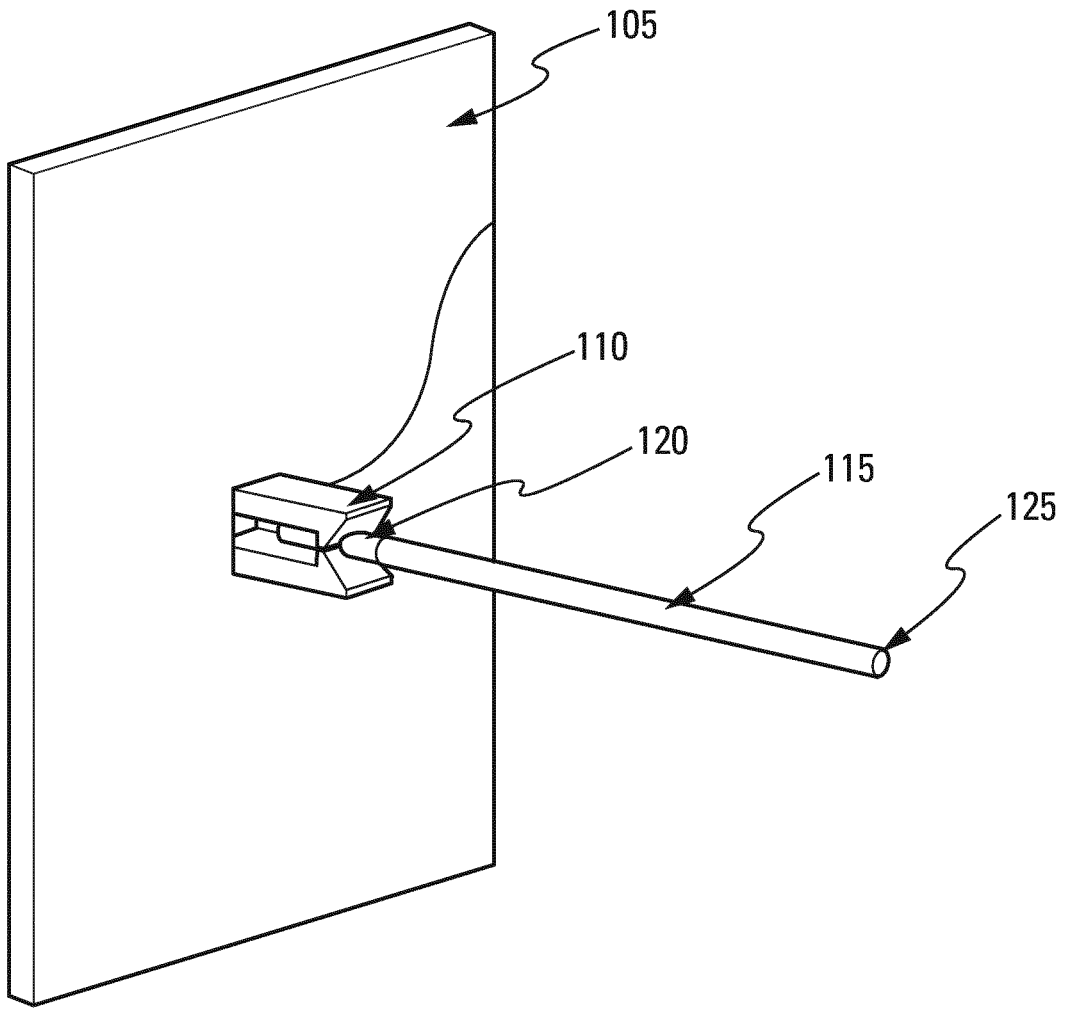
FIG. 2 shows a cut portion of the metalized part with integrated metalized retaining clip shown in the FIG. 1, in accordance with an embodiment of the present invention.

In an embodiment, the metalized plastic part 105 is connected to the ground. A grounding cable 115 is used to electrically connect the metalized plastic part 105 to the ground via the metalized retaining clip 110. One end of the metalized retaining clip 110 is fixed to the plastic metalized part 105 and another end of the metalized retaining clip 110 is formed with a locking portion to engage the ground cable 115 when inserted therein. The other end of the metalized retaining clip 115 may be herein referred as a locking end 305, as can be seen from the FIG. 3*b*. As can be seen from the FIG. 2 and the FIG. 3*c*, the grounding cable 115 is fixed to the locking end 305 of the metalized retaining clip 115 and a second end 125 of the grounding cable 115 is connected to the ground.

In an embodiment, the metalized retaining clip 110 is a type of a snap-fit connector connecting the grounding cable 115 and the metalized plastic part 105.

In an embodiment, the metalized retaining clip 110 comprises at least two jaws, as shown in the FIG. 3*c*. In an embodiment, the metalized retaining clip comprises two jaws 310, which are arranged parallely as shown in the FIG. 3*c*. The two jaws 310 can be moved away from other, i.e., the elastic movement of the jaws 310 allows to insert the ground cable 115 within the central passage 330.

In another embodiment, the metalized retaining clip 110 comprises three jaws. Yet, in another embodiment, the metalized retaining clip 110 comprise four jaws. Each jaw 310 is formed with a protrusion 315 at the locking end 305. The jaws 310 are arranged in such a way that the protrusions faces of the jaws face each other so as to form the central passage 330 to receive the one end 120 of the ground cable 115 when inserted therein. FIG. 3*a* is a front view of the cut portion of the metalized part with the integrated metalized retaining clip shown in the FIG. 1, in accordance with an embodiment of the present invention. As shown in the FIG. 3*a*, the central passage 330 is formed when the jaws 310 are assembled together to form the locking end 305.

In an embodiment, the protrusions 315 include sharp edges 320 facing each other as shown in the FIG. 3*c*. In another embodiment, the protrusions 315 include cut or truncated edges facing each other (not shown in the Figures). The truncated edges provides good contact surface between the ground cable 115 and the metalized retaining clip 110, hence ensuring better retaining force and conductivity. Thus, the present invention provides good contact surface 325 that ensures proper fixing of the ground cable 115 with the metalized retaining clip 110.

In another embodiment of the present invention, the grounding cable 115 is provided with a terminal clip 405 to engage with the locking end 305 of the metalized retaining clip 110. FIG. 4 shows the ground cable 115 with the terminal clip 110, in accordance with an embodiment of the present invention. The terminal clip 110 is made from synthetic polymer material or from metal. The terminal clip 110 may further improve the mechanical fixing between the metalized retaining clip 110 and the ground cable 115.

Thus, without additional components or without any additional process, good connection can be ensured between the metalized plastic part 105 and the ground through the metalized retaining clip 110 and the ground cable 115. The metalized retaining clip 110 assures a permanent connection between the ground cable 115 and the metalized plastic part 105. Therefore, the present invention provides a simple and economic solution to ground the metalized part without any SMT components, screws, connectors, or crimping process.

The invention claimed is:

1. A vehicle lamp comprising:

a metalized part that is made in synthetic polymer and that is metalized at least on one side of it, wherein, the vehicle lamp further comprises a metalized retaining clip integral with the metalized part, and a grounding cable electrically connecting the metalized part to the ground via the metalized retaining clip, and wherein the metalized retaining clip is a type of a snap-fit connector connecting the grounding cable and the metalized part.

2. The vehicle lamp as claimed in claim 1, wherein a first end of the grounding cable is fixed to a locking end of the metalized retaining clip and a second end of the grounding cable is connected to the ground.

3. The vehicle lamp as claimed in claim 2, wherein the metalized retaining clip comprises at least two jaws.

4. The vehicle lamp as claimed in claim 2, wherein the first end of the grounding cable includes a terminal clip to lock with the locking end of the metalized retaining clip.

5. The vehicle lamp as claimed in claim 2, wherein the metalized retaining clip comprises at least two jaws.

6. The vehicle lamp as claimed in claim 1, wherein the metalized part is a reflector.

7. The vehicle lamp as claimed in claim 6, wherein the metalized retaining clip is formed integrally with the reflector at lower portion of a side opposite to a reflective side of the reflector.

8. The vehicle lamp as claimed in claim 1, wherein the vehicle lamp further comprises:

a transparent outer lens;

one or more light emitting diodes that emit light, wherein the one or more light emitting diodes being disposed on an inner side of the transparent surface cover;

a printed circuit board (PCB) to carry the one or more light emitting diodes, and the PCB is arranged on a metalized heat sink; and wherein the metalized part is fixed to the metalized heat sink by fasteners.

9. The vehicle lamp as claimed in claim 1, wherein the first end of the grounding cable includes a terminal clip to lock with the locking end of the metalized retaining clip.

10. A vehicle lamp comprising:

a metalized part that is made in synthetic polymer and that is metalized at least on one side of it, wherein, the vehicle lamp further comprises a metalized retaining clip integral with the metalized part, and a grounding cable electrically connecting the metalized part to the ground via the metalized retaining clip, wherein the metalized part is a reflector, wherein the vehicle lamp further comprises:

a transparent outer lens;

one or more light emitting diodes that emit light, wherein the one or more light emitting diodes being disposed on an inner side of the transparent surface cover;

a printed circuit board (PCB) to carry the one or more light emitting diodes, and the PCB is arranged on a metalized heat sink; and wherein the metalized part is fixed to the metalized heat sink by fasteners.

11. The vehicle lamp as claimed in claim 10, wherein the metalized part is a reflector.

12. The vehicle lamp as claimed in claim 11, wherein the first end of the grounding cable includes a terminal clip to lock with the locking end of the metalized retaining clip.

13. The vehicle lamp as claimed in claim 11, wherein the metalized retaining clip comprises at least two jaws.

14. A vehicle lamp comprising:

a metalized part that is made in synthetic polymer and that is metalized at least on one side of it, wherein, the vehicle lamp further comprises a metalized retaining clip integral with the metalized part, and a grounding cable electrically connecting the metalized part to the ground via the metalized retaining clip, wherein a first end of the grounding cable is fixed to a locking end of the metalized retaining clip and a second end of the grounding cable is connected to the ground, and wherein the first end of the grounding cable includes a terminal clip to lock with the locking end of the metalized retaining clip.

15. The vehicle lamp as claimed in claim 14, wherein the terminal clip is made from synthetic polymer material or from metal.

16. The vehicle lamp as claimed in claim 14, wherein the first end of the grounding cable includes a terminal clip to lock with the locking end of the metalized retaining clip.

17. The vehicle lamp as claimed in claim 14, wherein the metalized retaining clip comprises at least two jaws.

* * * * *